US005636536A

United States Patent [19]

Kinnucan

[11] Patent Number: 5,636,536

[45] Date of Patent: Jun. 10, 1997

[54] REMOTELY OPERABLE SECURITY DEADBOLT LOCK DEVICE WITH ANTI-THEFT MANUALLY OPERABLE RELEASE

[76] Inventor: James A. Kinnucan, 1001 N. Oak Park Ave., Oak Park, Ill. 60302

[21] Appl. No.: 569,869

[22] Filed: Dec. 8, 1995

[51] Int. Cl.[6] ..... E05B 59/00

[52] U.S. Cl. ..... 70/107; 70/257; 70/279; 292/144

[58] Field of Search ..... 70/257, 104, 107, 70/111, 131, 279; 292/144

[56] References Cited

U.S. PATENT DOCUMENTS

| | | | |
|---|---|---|---|
| 3,601,453 | 8/1971 | Silverman | 303/89 |
| 3,820,284 | 6/1974 | Boughton . | |
| 3,830,332 | 8/1974 | Fontaine | 180/113 |
| 3,953,991 | 5/1976 | Grossman | 70/104 |
| 4,372,419 | 2/1983 | Barnett et al. | 180/289 |
| 4,744,021 | 5/1988 | Kristy . | |
| 4,794,268 | 12/1988 | Nakano et al. . | |
| 5,263,347 | 11/1993 | Allbaugh et al. | 70/257 |
| 5,386,713 | 2/1995 | Wilson | 70/280 |
| 5,531,086 | 7/1996 | Bryant | 70/279 |

*Primary Examiner*—Steven N. Meyers
*Assistant Examiner*—Donald J. Lecher
*Attorney, Agent, or Firm*—Welsh & Katz, Ltd.

[57] ABSTRACT

An improved remotely operable security deadbolt lock device and a module therefor having an anti-theft manually operable release for a vehicle, particularly a vehicle having mating doors, such as a cargo van, includes a deadbolt having a plunger in a housing for securing the deadbolt when the deadbolt is in the locked position. The device is remotely operable by having an actuator operably connected to the deadbolt, a receiver capable of receiving a selected electrical signal to cause the actuator to be energized, and a transmitter remote from the receiver capable of transmitting the selected electrical signal to the receiver. The device further includes a manually manipulable release device including a crank arm within the housing coupled to the plunger by a shaft passing therethrough, and the crank arm having a hook and the housing having a catch for the hook. The lock device can be opened from within the vehicle without using the remotely operable elements of the device, by manually rotating a knob secured to the shaft, causing the crank arm to rotate, and hence the hook to rotate out of the catch, permitting the plunger to be manually slid into the unlocked position by sliding the knob and shaft in the direction away from the locked position.

13 Claims, 3 Drawing Sheets

REMOTELY OPERABLE SECURITY DEADBOLT LOCK DEVICE WITH ANTI-THEFT MANUALLY OPERABLE RELEASE

BACKGROUND OF THE INVENTION

1. Field of the Invention

The present invention relates to lock devices for vehicles, and more particularly, to a remotely operable security deadbolt lock device with an anti-theft manually operable release for a vehicle, particularly for a pair of doors enclosing a cargo space.

2. Description of Related Art

Remote control deadbolt locks have been disclosed for passenger automotive vehicles, as in U.S. Pat. Nos. 4,744,021; 5,263,347 and 5,386,713. However, these devices require door jambs and do not provide for an easily manually operated release which is relatively theft-proof.

Cargo vans in which a pair of rear doors are utilized to enclose the cargo space present a particularly unique security problem. The keyed lock provided by the manufacturer in one of the doors, which interacts with the other door, is particularly susceptible to being burglarized, for example, by picking or physically removing the lock, and the contents of the cargo space being stolen. The burglarizing of cargo vans in this manner, particularly in larger cities is quite prevalent. One common method to deter the burglarizing of cargo vans is to install a hasp on the outside of the pair of doors and to secure the hasp with a padlock. However, the presence of a hasp and padlock on the outside of the doors is unsightly, the lock cannot be unlocked by remote control, and there is no provision for an authorized driver, helper or other person opening the doors from inside the van. The latter may be particularly disadvantageous if the authorized person is inside the cargo space and an emergency occurs, such as a fire, and the person must quickly exit the cargo space. Hence, there is a need for a lock device, particularly for the rear doors of a cargo van, which can be remotely operable, and which includes a release which is easily manually operable from inside the cargo space of the van and which is relatively theft-proof.

SUMMARY OF THE INVENTION

Therefore, it is one object of the present invention to provide a remotely operable security deadbolt lock device with an anti-theft manually operable release for a vehicle.

Another object of the present invention to provide a deadbolt lock device which is particularly useful to secure the rear doors of a cargo van.

It is another object of the present invention to provide a remotely operable security deadbolt lock device which can be easily opened from inside the enclosed space by manual manipulation of manually operable release means which is not operable from outside the enclosed space by use of a lever bar, coat hanger or other lever dependent device.

It is still another object of the present invention is to provide a remotely operable security deadbolt lock device for a cargo van to secure the rear doors of the van in which the device includes manually operable release means which is operable from inside the cargo space of the van by manually rotating an element of the device.

Still another object of the present invention is to provide a pre-assembled remotely operable security deadbolt lock device module, including an anti-theft manually operable release, with the module further including a mounting member, which facilitates installation of the device in a vehicle.

These and other objects and advantages of the present invention will be apparent from the following description.

In accordance with the present invention, an improved remotely operable security deadbolt lock device having an anti-theft manually operable release is provided for a vehicle, which is particularly usable to secure a pair of mating doors, such as the rears doors of a cargo van to enclose the cargo space. The improved device includes deadbolt means mounted on, in or adjacent a closure of an entryway of a vehicle and receiving means mounted on an adjacent closure or other structure adjacent to the deadbolt means for receiving a portion of the deadbolt means and for securing the deadbolt means, and hence the entryway, when the deadbolt means is in the locked position. Preferably in accordance with this invention, the deadbolt means and the receiving means therefor are installed in or on the interior surface of respective ones of a pair of doors meeting to enclose a space, with the deadbolt means and the receiving means cooperating with each other to secure the pair of doors.

The deadbolt lock device of the present invention is remotely operable by having an actuator, such as a motor operated by a solenoid, mounted on the structure, e.g. the door, on which the deadbolt means is mounted and operably connected to the actuator, a receiver capable of receiving a selected electrical signal and electrically coupled to the actuator, for example to the solenoid, to cause the motor to be energized upon receiving the selected electrical signal to move the deadbolt means between the locked and the unlocked positions, and a transmitter remote from the receiver capable of transmitting the selected electrical signal to the receiver.

The deadbolt lock device of the present invention further includes manually manipulable release means within the vehicle to permit the lock device to be opened from within the vehicle without using the remotely operable elements of the device. The manually manipulable release means within the vehicle is operably connected with the deadbolt device for releasing the deadbolt when the release means is manually manipulated when the deadbolt device is in the locked position. The manipulable release means is inoperable except upon its manual manipulation.

In one embodiment, the deadbolt means includes a deadbolt plunger and a crank arm coupled to the plunger for sliding movement therewith between the locked and unlocked positions of the deadbolt means. The deadbolt means can further include a housing through which the deadbolt plunger and at least a portion of the crank arm can move between the locked position and the unlocked position. The housing can be mounted as described above for the deadbolt means, and the crank arm of the deadbolt means can have a hook extending therefrom, with the housing having catch means adapted and positioned for retaining the hook of the crank arm when the deadbolt plunger is in the locked position.

In another embodiment, the manually manipulable release means comprises a knob secured to a rotatable shaft affixed to a crank arm which is pivotable on the deadbolt plunger, a hook on the crank arm, and catch means adjacent the deadbolt plunger to engage the hook when the deadbolt device is in the locked position. In this embodiment, the catch means, is preferably an opening in the housing of the deadbolt plunger, and upon manual rotation of the knob, the shaft rotates to pivot the crank arm and the hook thereof away from the opening permitting the deadbolt plunger to be manually slid to the unlocked position and away from the receiving means for the plunger, which can be a strike plate on the adjacent door. In this embodiment, the release device is manually inoperable except upon manual rotation of the knob and shaft, and is relatively burglar proof as it cannot be operated by inserting a hooked wire through a space between the doors or by creating such a space by causing a wire to push aside a door seal or gasket to form a space in order to insert a hooked wire to manipulate the knob.

In still another embodiment, the actuator includes a motor and a pinion and a rack which is reciprocally operated, with the rack being connected either directly or indirectly to the deadbolt plunger. If the rack is directly connected to the deadbolt plunger, upon actuation of the motor, the rack and the deadbolt plunger are moved between the locked position and the unlocked position of the deadbolt device. If the rack is indirectly connected to the deadbolt plunger it may be so connected by a lever arm, whereby upon actuation of the motor the rack is moved and the deadbolt plunger is moved by the lever arm between the locked position and the unlocked position.

In another embodiment, the device of the present invention includes a pre-assembled remotely operable security deadbolt lock device module which facilitates installation of the device in a vehicle. The module desirably includes a mounting member on which is mounted the deadbolt housing, the deadbolt plunger, the crank arm with the hook extending therefrom coupled to the deadbolt plunger for sliding movement therewith, the actuator, and the manually manipulable release means, as described above. In addition, the housing desirably has catch means as described above, adapted and positioned for retaining the hook of the crank arm when the deadbolt plunger is in the locked position. The mounting plate of the module also desirably includes mounting means to facilitate mounting of module in the vehicle, for example, on one of the cargo doors of a van adjacent the edge of the door, so that the deadbolt plunger can engage a receiving means mounted on the adjacent cargo door of a van.

The invention will be more readily understood from the accompanying drawings which are to be read in conjunction with the description of the preferred embodiment, both showing and describing for illustration, a deadbolt lock device on one of a pair of cargo van doors.

DESCRIPTION OF THE PREFERRED EMBODIMENT

Figure 2:
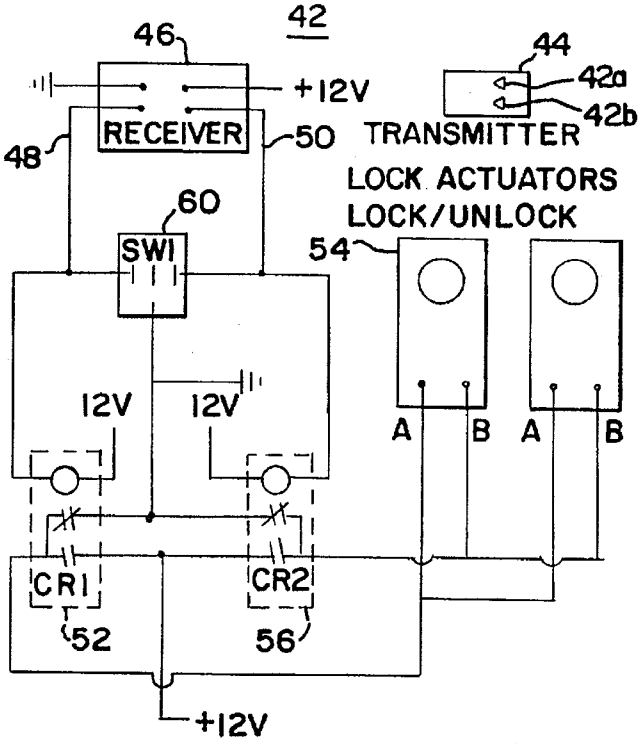
FIG.2 is a schematic drawing of a wireless control system for the remotely operable security deadbolt lock device of the present invention.

In the preferred embodiment of the present invention, shown in the drawings, the remotely operable security deadbolt lock device with an anti-theft manually operable release is designated generally by the numeral 10.

Device 10 includes a deadbolt 12 having a deadbolt plunger 14 positioned within a housing 16 which is mounted within one door 18 of a pair of cargo doors 20 of a vehicle, such as a cargo van. The side edge 22 of door 18 is adjacent and faces the side edge 24 of the other door 26 of the pair of cargo doors 20 when the pair of doors 20 are in the closed position. As is common, door 18 has an outer panel portion 28 which overlaps the space between edges 22 and 24 to prevent wind, rain and other elements from entering the cargo space enclosed by the pair of doors 20, and to deter the inserting of a bar or lever into the space between doors 18 and 26 to force open the doors in order to gain unauthorized entry into the cargo space. Door 18, with its overlapping panel portion 28, thus engages door 26 in the closed position.

Figure 1:
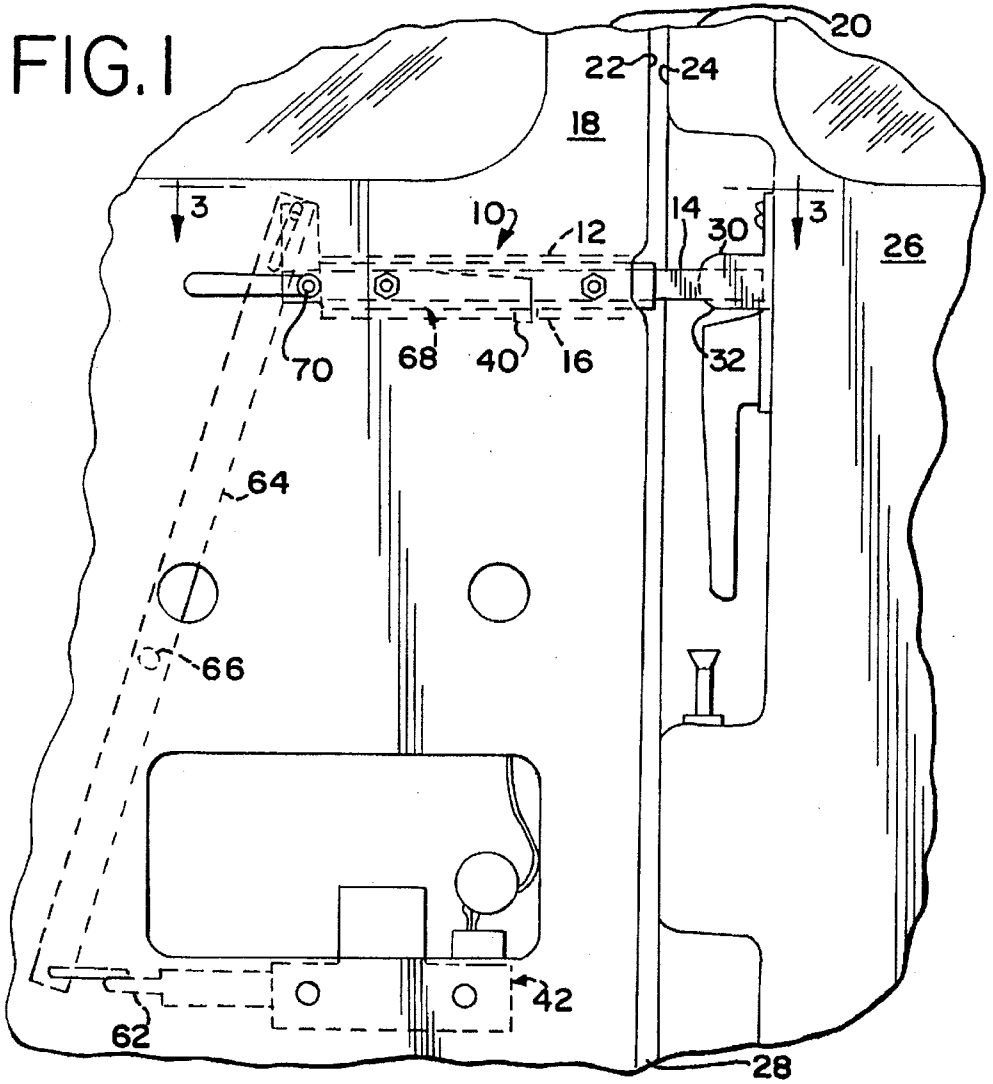
FIG. 1 is a schematic drawing showing a device of the present invention installed on a pair of cargo doors of a van.
Figure 3:
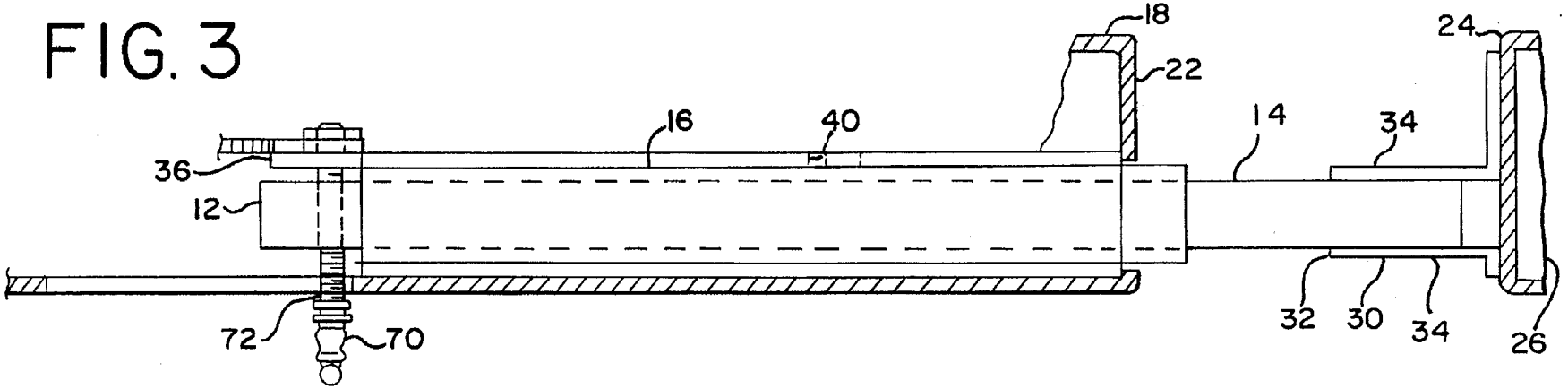
FIG. 3 is a partially fragmented top view showing the deadbolt device taken along line 3—3 of FIG. 1.
Figure 4:
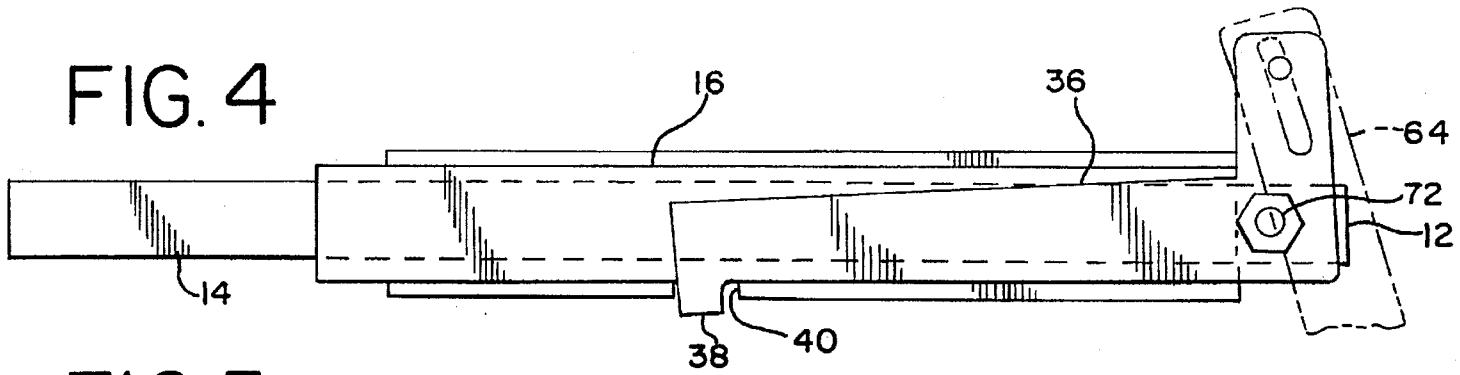
FIG. 4 is a rear elevational view of the deadbolt, crank arm and a portion of the lever arm of the device of FIG. 3 in the locked position and turned end-for-end.
Figure 5:
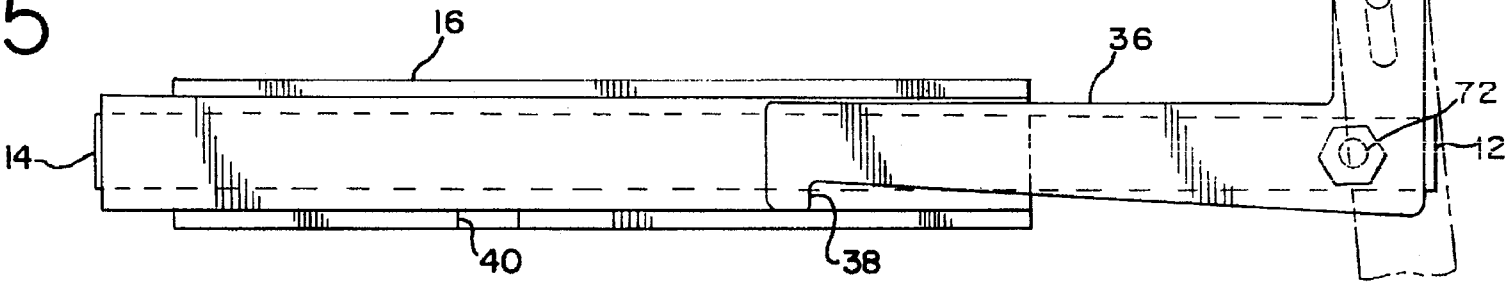
FIG. 5 is a view identical to FIG. 4, showing the deadbolt, crank arm and lever arm in the unlocked position.
Figure 6:
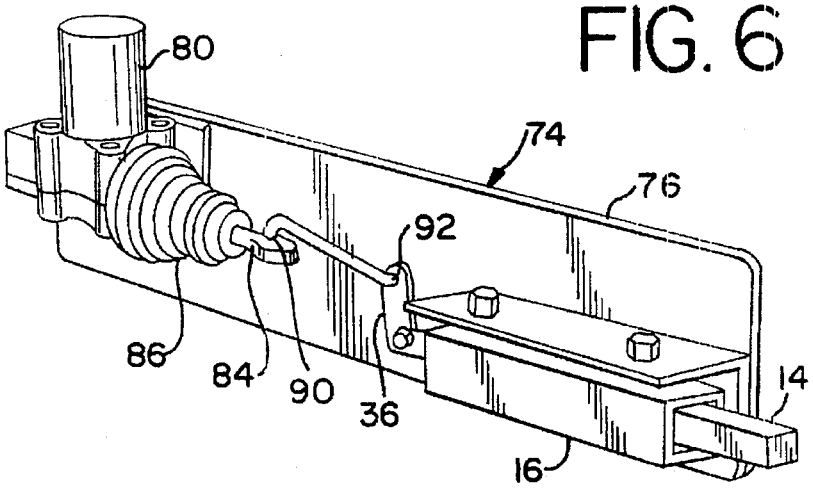
FIG. 6 is a perspective view of a pre-assembled remotely operable security deadbolt lock device module in accordance with the invention.

Lock device 10 also includes receiving means for receiving a portion of the deadbolt 12 and securing the deadbolt 12 when in the locked position. In the preferred embodiment shown in the drawings, the receiving means is a strike plate 30 mounted within the vehicle on the other cargo door 26 at its edge 24 facing edge 22 of cargo door 18, and preferably a portion of edge 24 spaced from the remainder of the door edge as shown in FIG. 1. Strike plate 30 is mounted on door 26 so that an opening 32 therein extends through edge 24 and receives deadbolt plunger 14, which in its locked position as shown in FIGS. 3 and 4, extends beyond the edge 22 of cargo door 18 on which deadbolt 12 and housing 16 are mounted. Strike plate 30 also includes a reinforcing plate 34 against which the extended portion of plunger 14 can rest to secure deadbolt 12 when the deadbolt is in the locked position with cargo doors 20 closed, to provide added protection against the doors 20 being forced open.

Deadbolt lock device 10 further includes a crank arm 36 coupled to deadbolt plunger 14 and positioned within housing 16 for sliding movement therewith between the locked and unlocked positions of the deadbolt. Crank arm 36 has a hook 38 extending therefrom, and housing 16 has catch means adapted and positioned for retaining hook 38 when the deadbolt plunger is in the locked position. The catch means in the preferred embodiment shown in the drawings is an opening 40 defined in housing 16, for example in the bottom of the housing, not visible to the eye except upon inspection of the bottom of housing 16, whereby hook 38 of crank arm 36 may enter and be retained therein when deadbolt 12 is in the locked position.

As shown in FIG. 2, the remotely operable security deadbolt lock device 10 includes a wireless control system 42. Included in the wireless control system 42 is a wireless transmitter 44 and receiver 46. The wireless transmitter 44 is battery operated and of a sufficiently small size and weight to be conveniently attached to a key chain or the like.

The transmitter 44 and receiver 46 transceive two distinct signals (i.e., lock and unlock). The lock signal is transceived whenever a first button **42*a* on the transmitter 42 is activated. Activation of the lock button 42*a* causes a lock output 48 of the receiver 46 to be pulled low. Similarly, the unlock signal is transceived whenever the unlock button 42*b* is activated which, in turn, causes the unlock output 50 of the receiver 46** to be pulled low.

The two signals may be transceived under any appropriate format (e.g., AM, FM, CDMA, etc.). Under a preferred embodiment, the signals are transmitted digitally under a dual frequency, FM format. The use of a dual frequency FM format allows a unique code to be entered into both transmitter 42 and receiver 44 for an enhanced level of security.

The lock actuators 54, 58 may be any bidirectional device, e.g., a servomotor driving a rack and pinion actuator. Placing a positive 12 volts on an "A" terminal and grounding the "B" terminal causes the actuator 54, 58 to drive towards a locked position. Placing a positive 12 volts on the "B" terminal and ground on the "A" terminal causes the actuator 54, 58 to drive towards an unlocked position.

With the wireless control system 42 in a quiescent state (i.e., neither button 42*a*, 42*b* actuated) causes the control relays 52, 56 to remain in a deactivated state. With the control relays in a deactivated state, terminals "A" and "B" of the actuators 54, 58 are grounded through the normally closed contacts of the control relays 52, 56.

Upon receiving a lock signal, the first output 48 of the receiver 46 activates a first relay 52 which in turn places 12 volts on the "A" terminals which in turn drives the actuator 54, 58 to a locked position. Similarly upon the receipt of an unlock signal, a second output 50 activates a second relay 56 which, in turn, drives the actuators 54, 58 to an unlocked position.

Also shown in FIG. 2 is a manually activated switch 60. The manual switch 60 is located inside the vehicle (e.g., beside the driver's seat) allowing for local control of the remotely operable security deadbolt lock device 10.

In the remotely operable security deadbolt lock device 10 shown in the drawings, actuators 54 and 58 act through a pinion on a rack 62 which is reciprocally operated thereby, rack 62 being connected to deadbolt plunger 14 by a lever arm 64, as best shown in FIG. 1. Rack 62 could also be directly connected, e.g., integral, with plunger 14 (which arrangement is not shown), so that plunger 14 would be reciprocally moved directly by actuators 54 and 58. Lever arm 64 is conveniently anchored by a rivet 66 in door 18, which serves as a pivot for lever arm 64 providing a mechanical advantage to the device in operating plunger 14 between the locked and unlocked positions. In this arrangement, upon actuation of actuator 54 or 58, rack 62 is moved and deadbolt plunger 14 is moved by lever arm 64 between the locked position and the unlocked position.

The deadbolt lock device 10 of the embodiment shown in the drawing further includes a manually manipulable release device 68 within the vehicle for safety and for convenience of persons within the cargo space of the vehicle in being able to quickly and easily open the doors without use of the remote unlocking device or the manual switch 60 within the vehicle. The manually manipulable release device 68 of this embodiment does not depend on the electrical system of the vehicle, and is operable even if the electrical system of the vehicle is disabled. The release device 68 includes a knob 70 secured to a rotatable shaft 72 affixed to crank arm 36. Upon manual rotation of knob 70, clockwise as shown in FIGS. 1 and 3, shaft 72 rotates to pivot crank arm 36 and hook 38 thereof away from and out of catch opening 40 in housing 16, permitting deadbolt plunger 14 to be manually slid away from strike plate 30 by sliding knob 70 and shaft 72, and hence crank arm 36 and plunger 14, to the left in FIGS. 1 and 3. Manually operable release device 68 is inoperable except upon manual rotation of knob 70 and shaft 72, as it is held in the locked positioned by hook 38 residing within opening 40 when the deadbolt device is in the locked position.

Figure 7:
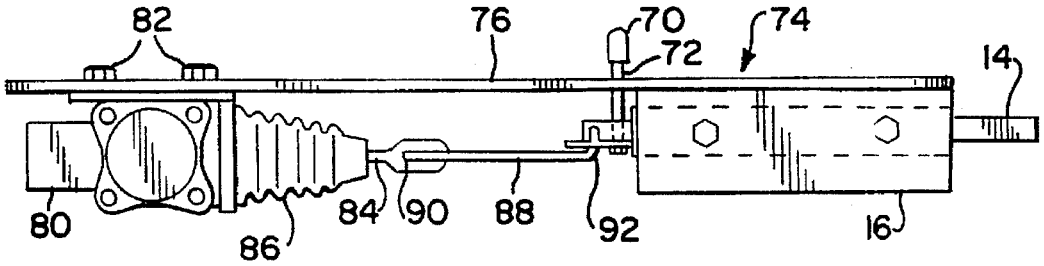
FIG. 7 is a top view of the module of FIG. 6.
Figure 8:
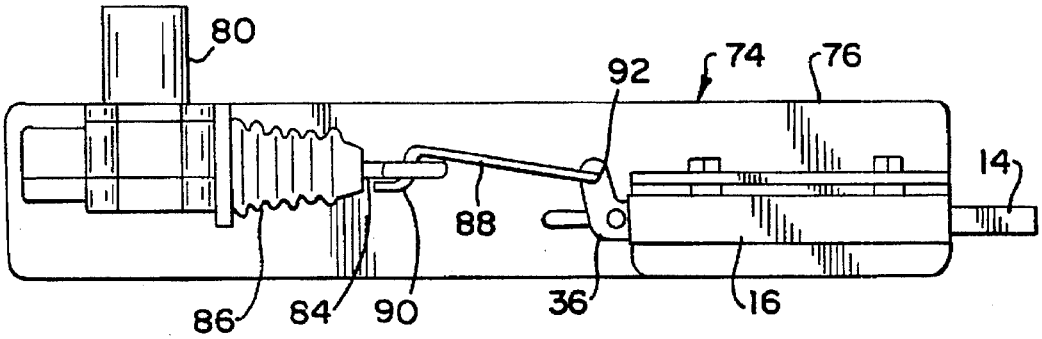
FIG. 8 is a front view of the module of FIG. 6.
Figure 9:
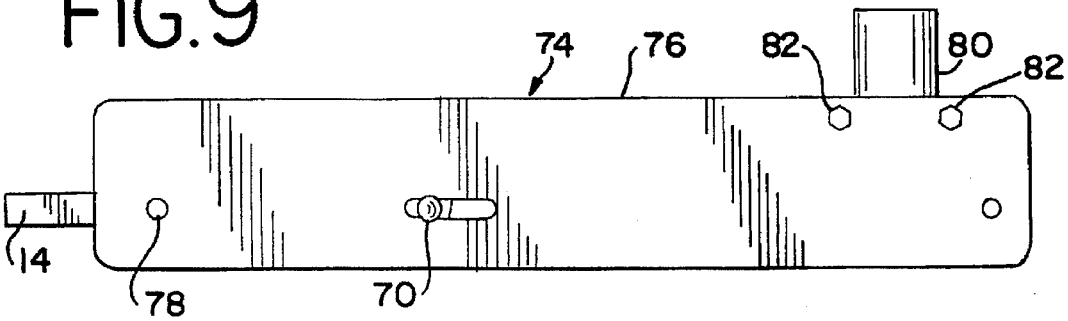
FIG. 9 is a rear view of the module of FIG. 6.

FIGS. 6–9, illustrate a pre-assembled remotely operable security deadbolt lock device module 74 in accordance with the invention. In particular, module 74 includes a mounting member, which as shown can be a mounting plate 76, having means (not shown), such as apertures, for mounting the module to the vehicle, for example, in the same manner as the deadbolt 12 and the housing 16 are mounted to door 18, as shown in FIG. 1. In this embodiment, housing 16 is mounted on plate 76, for example, by means of fastener 78 (FIG. 9), such as a machine screw threaded into a threaded aperture in housing 16. Positioned in housing 16 are the deadbolt 12, the deadbolt plunger 14 and the crank arm 36, for sliding movement together, as described above, within housing 16. Housing 16 also includes an opening (not shown in FIGS. 6–9) which can be the same as opening 40, shown in FIG. 4, which serves as catch means for the hook (also not shown in FIGS. 6–9) on crank arm 36, which can be the same as hook 38 also shown in FIG. 4. The deadbolt device in this embodiment includes a manually manipulable release device 68 as heretofore described, and is not further described here for the sake of brevity, although the knob 70 and shaft 72 are shown in FIG. 7. Actuators (only one actuator 80 being shown in FIGS. 6–9) are mounted on plate 76 by means of fasteners 82 (FIG. 9), such as a machine screw threaded through apertures in plate 76 into nuts or threaded clips on the opposite side of plate 76. Rack 84 of actuator 80 extends through a boot 86, which can be, for example, rubber or plastic, and is coupled to crank arm 36 by a linking member, in this case rod 88 as shown, bent so as to enter into an aperture 90 in the extension of rack 84 and aperture 92 in crank arm 36. One or more retaining clips (not shown) can be present to secure rod 88 to either or both of the extension of rack 84 and crank arm 36. In this manner, upon actuator 80 being activated, rack 84 moves either toward or away from housing 16, and through rod 88, causes crank arm 36 to either rotate slightly to remove the hook of crank arm 36 from the opening (catch) of housing 16 and move the deadbolt plunger 14 to the left in FIGS. 6–8 and away from a receiving member (not shown in FIGS. 6–9) and further into housing 16, or in the opposite direction to extend plunger 14 toward and into a receiving member, and allow the hook of crank arm 36 to enter into and engage the opening in housing 16, to lock the deadbolt device 10.

While a particular embodiment of the lock device of the invention has been shown and described, it will be appreciated by those skilled in the art that changes and modifications may be made thereto without departing from the invention in its broader aspects and as set forth in the following claims.

What is claimed is:

1. A remotely operable security deadbolt lock device having an anti-theft manually operable release for a vehicle having at least one entryway defined by the vehicle and having a closure therefor for closing and securing the at least one entryway, said lock device comprising:

deadbolt means having a locked position and an unlocked position adapted for mounting on either one of the at least one entryway or on the closure therefor for securing the closure to the at least one entryway for preventing unauthorized opening of the closure;

said deadbolt means including a deadbolt plunger, a crank arm coupled to said plunger for sliding movement therewith between the locked and unlocked positions of said deadbolt means, and a housing through which said deadbolt plunger and at least a portion of the crank arm can move between the locked position and the unlocked position, said housing being adapted for mounting on either one of the at least one entryway or on the closure therefor, said crank arm of said deadbolt means having a hook extending therefrom, and said housing having catch means adapted and positioned for retaining said hook of said crank arm when said deadbolt plunger is in the locked position;

receiving means for receiving a portion of the deadbolt means and securing the deadbolt means when in the locked position, said receiving means being adapted for mounting on the other of the at least one entryway and the closure from which said deadbolt means may be mounted;

an actuator adapted for mounting on the one of the at least one entryway or the closure therefor on which the deadbolt means is adapted to be mounted, said actuator being operably connected to said deadbolt means;

a receiver capable of receiving a selected electrical signal and electrically coupled to said actuator to cause said actuator to be energized upon receiving the selected electrical signal to move said deadbolt means between the locked and the unlocked positions;

a transmitter remote from said receiver capable of transmitting the selected electrical signal to said receiver; and manually manipulable release means adapted to be positioned within the vehicle operably connected with said deadbolt means for releasing said deadbolt means from said receiving means when said release means is manually manipulated from within the vehicle when said deadbolt means is in the locked position, said manipulable release means being inoperable except upon manual manipulation of said manipulable release means, said manually manipulable release means comprising means secured to a rotatable shaft affixed to said crank arm for manually rotating said shaft, whereby upon manual rotation of said manually rotatable means said shaft rotates to pivot said crank arm and said hook thereof away from said catch means permitting said deadbolt plunger to be manually slid away from said receiving means therefor, thereby releasing said deadbolt means from said receiving means.

2. The remotely operable security deadbolt lock device as claimed in claim 1, wherein said actuator includes a pinion and a rack which is reciprocally operated thereby, said rack being connected to said deadbolt plunger, whereby upon actuation of said actuator said rack and said deadbolt plunger are moved between the locked position and the unlocked position.

3. The remotely operable security deadbolt lock device as claimed in claim 1, wherein said actuator includes a pinion and a rack which is reciprocally operated thereby, said rack being connected to said deadbolt plunger by a lever arm, whereby upon actuation of said actuator said rack is moved and said deadbolt plunger is moved by said lever arm moved between the locked position and the unlocked position.

4. A remotely operable security deadbolt lock device with an anti-theft manual release for a vehicle having a cargo space and having a pair of cargo doors for together closing and securing an entryway, the cargo doors having respective side edges thereof facing each other and for engaging each other when in their closed position for partially enclosing the cargo space of the vehicle, said deadbolt lock device comprising:

a deadbolt having a locked position and an unlocked position, said deadbolt being adapted for mounting within the vehicle on one of the cargo doors of the vehicle adjacent the side edge thereof facing the other cargo door for movement between a locked position and an unlocked position, said deadbolt in the locked position extending beyond the side edge of the door on which it is adapted to be mounted toward the other cargo door;

said deadbolt including a deadbolt plunger, a crank arm coupled to said plunger for sliding movement therewith between the locked and unlocked positions of said deadbolt, and a housing through which said deadbolt plunger and at least a portion of the crank arm can move between the locked position and the unlocked position, said housing being adapted for mounting on either one of the at least one entryway or on the door therefor, said crank arm of said deadbolt having a hook extending therefrom, and said housing having catch means adapted and positioned for retaining said hook of said crank arm when said deadbolt plunger is in the locked position;

receiving means for receiving the portion of said deadbolt extending beyond the edge of the cargo door on which said deadbolt is adapted to be mounted and securing said deadbolt when said deadbolt is in the locked position with the cargo doors closed, said receiving means being adapted to be mounted within the vehicle on the other cargo door adjacent its edge facing the cargo door on which said deadbolt may be mounted;

an actuator adapted for mounting within the vehicle on the cargo door on which said deadbolt may be mounted, said actuator being operably connected to said deadbolt to move said deadbolt between the unlocked and locked positions of said deadbolt;

a receiver capable of receiving a selected electrical signal and electrically coupled to said actuator to cause said actuator to be energized upon receiving the selected electrical signal to move the deadbolt between the locked and the unlocked positions;

a transmitter remote from said receiver capable of transmitting the selected electrical signal to said receiver; and a manually manipulable release device adapted to be positioned within the vehicle operably connected with said deadbolt for releasing said deadbolt from said receiving means when said release device is manually manipulated from within the vehicle when said deadbolt is in the locked position, said manipulable release device being inoperable except upon manual manipulation of said release device, said manually manipulable release device comprising means secured to a rotatable shaft affixed to said crank arm for manually rotating said shaft, whereby upon manual rotation of said manually rotatable means said shaft rotates to pivot said crank arm and said hook thereof away from said catch means permitting said deadbolt plunger to be manually slid away from said receiving means therefor, thereby releasing said deadbolt from said receiving means.

5. The remotely operable security deadbolt lock device as claimed in claim 4, wherein said manually manipulable release device comprises a knob secured to a rotatable shaft affixed to said crank arm, whereby upon manual rotation of said knob said shaft rotates to pivot said crank arm and said hook thereof away from said catch means permitting said deadbolt plunger to be manually slid away from said receiving means therefor, thereby releasing said deadbolt plunger from said receiving means.

6. The remotely operable security deadbolt lock device as claimed in claim 4, wherein said actuator includes a pinion and a rack which is reciprocally operated thereby, said rack being connected to said deadbolt plunger, whereby upon actuation of said actuator, said rack and said deadbolt plunger are moved between the locked position and the unlocked position.

7. The remotely operable security deadbolt lock device as claimed in claim 4, wherein said actuator includes a pinion and a rack which is reciprocally operated thereby, said rack being connected to said deadbolt plunger by a lever arm, whereby upon actuation of said actuator, said rack is moved and said deadbolt plunger is moved by said lever arm between the locked position and the unlocked position.

8. The remotely operable security deadbolt lock device as claimed in claim 4, wherein said receiving means is a strike plate adapted for mounting within the vehicle on the other cargo door adjacent its edge facing the cargo door on which said deadbolt may be mounted, said strike plate being adapted to receive the portion of said deadbolt plunger extending beyond the edge of the cargo door on which said deadbolt may be mounted and to secure said deadbolt when said deadbolt is in the locked position with the cargo doors closed.

9. The remotely operable security deadbolt lock device as claimed in claim 4, wherein said catch means is an opening defined in said housing whereby said hook of said crank arm may enter and be retained therein when said deadbolt is in the locked position.

10. A remotely operable security deadbolt lock device with an anti-theft manually operable release for a vehicle having a cargo space and having a pair of cargo doors having respective side edges thereof for engaging each other when in their closed position for partially enclosing the cargo space of the vehicle, said deadbolt lock device comprising:

a deadbolt having a locked position and an unlocked position and including a deadbolt plunger and a crank arm coupled to said plunger for sliding movement therewith between the locked and unlocked positions, said deadbolt plunger and said crank arm being positioned within a housing through which said deadbolt plunger and at least a portion of the crank arm can move between the locked position and the unlocked position of said deadbolt plunger, said housing being adapted for mounting within the vehicle on one of the cargo doors of the vehicle adjacent the side edge thereof facing the other cargo door, said crank arm having a hook extending therefrom, and said housing having catch means adapted and positioned for retaining said hook of said crank arm when said deadbolt plunger is in the locked position, said deadbolt plunger in the locked position adapted and positioned for extending beyond the side edge of the door on which it may be mounted toward the other cargo door;

a strike plate adapted for mounting within the vehicle on the other cargo door adjacent its edge facing the cargo door on which said deadbolt plunger is adapted for mounting said strike plate being adapted to receive the portion of said deadbolt plunger adapted for extending beyond the edge of the cargo door on which said deadbolt may be mounted and for securing said deadbolt when said deadbolt is in the locked position with the cargo doors closed;

an actuator adapted for mounting within the vehicle on the cargo door on which said deadbolt is adapted to be mounted, said actuator being operably connected to said deadbolt plunger to move said deadbolt plunger between the unlocked and locked positions of said deadbolt plunger;

a receiver capable of receiving a selected electrical signal and electrically coupled to said actuator to cause said actuator to be energized upon receiving the selected electrical signal to move the deadbolt plunger between the locked and the unlocked positions;

a transmitter remote from said receiver capable of transmitting the selected electrical signal to said receiver; and a manually manipulable release device adapted to be positioned within the vehicle comprising a knob secured to a rotatable shaft affixed to said crank arm, whereby upon manual rotation of said knob, said shaft rotates to pivot said crank arm and said hook thereof away from said catch means permitting said deadbolt plunger to be manually slid away from said strike plate, said release device being inoperable except upon manual rotation of said knob and shaft.

11. The remotely operable security deadbolt lock device as claimed in claim 10, wherein said catch means is an opening defined in said housing whereby said hook of said crank arm may enter and be retained therein when said deadbolt is in the locked position.

12. A remotely operable security deadbolt lock device module with an anti-theft manually operable release for a vehicle having at least one entryway defined by the vehicle and having a closure therefor for closing and securing the at least one entryway, said module comprising:

a mounting plate, said mounting plate including mounting means adapted for mounting said module in the vehicle;

a deadbolt having a locked position and an unlocked position and including a deadbolt plunger and a crank arm coupled to said plunger for sliding movement therewith between the locked and unlocked positions, said deadbolt plunger and said crank arm being adapted to be positioned within a housing through which at least a portion of said deadbolt plunger and at least a portion of the crank arm can move between the locked position and the unlocked positions of said deadbolt plunger, said housing being mounted on said mounting plate;

said mounting plate adapted for mounting on either one of the at least one entryway or on the closure therefor to enable said deadbolt in the locked position to secure the closure to the at least one entryway to prevent unauthorized opening of the closure;

said crank arm having a hook extending therefrom, and said housing having catch means adapted and positioned for retaining said hook of said crank arm when said deadbolt plunger is in the locked position;

an actuator mounted on said mounting plate, said actuator being operably connected to said deadbolt plunger to move said deadbolt plunger between the unlocked and locked positions of said deadbolt plunger; and a manually manipulable release device comprising a knob secured to a rotatable shaft affixed to said crank arm, whereby upon manual rotation of said knob, said shaft rotates to pivot said crank arm and said hook thereof away from said catch means permitting said deadbolt plunger to be manually slid away from the locked position to the unlocked position, said release device being inoperable except upon manual rotation of said knob and shaft.

13. The remotely operable security deadbolt lock device module as claimed in claim 12, wherein said catch means is an opening defined in said housing whereby said hook of said crank arm may enter and be retained therein when said deadbolt is in the locked position.

* * * * *